United States Patent [19]

Matsui

[11] 4,203,771

[45] * May 20, 1980

[54] GREEN SAND COMPOSITION FOR CASTING

[76] Inventor: Hirofumi Matsui, No. 6-16, 2-chome, Higashi, Shibuya-ku, Tokyo, Japan

[ * ] Notice: The portion of the term of this patent subsequent to Jan. 30, 1996, has been disclaimed.

[21] Appl. No.: 951,800

[22] Filed: Oct. 16, 1978

Related U.S. Application Data

[63] Continuation-in-part of Ser. No. 785,312, Apr. 8, 1977, Pat. No. 4,137,085.

[30] Foreign Application Priority Data

Apr. 8, 1976 [JP] Japan ..... 51-40047

[51] Int. Cl.[2] ..... B28B 7/34

[52] U.S. Cl. ..... 106/38.35; 106/38.3; 106/38.5 R; 106/38.6; 106/38.8; 106/68; 106/69; 106/71

[58] Field of Search ..... 106/38.3, 38.35, 38.8, 106/38.9, 38.5 R, 38.6, 68, 69, 71, 38.7

[56] References Cited

U.S. PATENT DOCUMENTS

| | | | |
|---|---|---|---|
| 1,221,259 | 4/1917 | Woddrop | 106/38.8 |
| 1,673,356 | 6/1928 | Hanley | 106/38.5 |
| 3,023,113 | 2/1962 | Barlow | 106/38.8 |
| 3,053,671 | 9/1962 | Tobler | 106/38.6 |
| 3,086,874 | 4/1963 | Wallace et al. | 106/38.5 |
| 3,086,875 | 4/1963 | Wallace et al. | 106/38.5 |
| 3,095,310 | 6/1963 | Wallace et al. | 106/38.5 |
| 3,445,251 | 5/1969 | Nevins | 106/38.3 |
| 3,804,641 | 4/1974 | Lyass et al. | 106/38.35 |
| 4,137,085 | 1/1979 | Matsui | 106/38.35 |

FOREIGN PATENT DOCUMENTS

| | | | |
|---|---|---|---|
| 1029809 | 5/1966 | United Kingdom | 106/38.9 |
| 1293837 | 10/1972 | United Kingdom | 106/38.35 |

OTHER PUBLICATIONS

Amer. Colloid Company, "Clay Tech., Part 5", 11/69.

The Brit. Foundryman, vol. 70, Part 9, pp. 241–249 (1977).

Felicetta, "Lignin VII, Distribution in Mol. Wt. of Certain Lignin Sulfonates", J.A.C.S., vol. 78, No. 9, pp. 1099–1904 (1956).

*Primary Examiner*—Lorenzo B. Hayes

*Attorney, Agent, or Firm*—Fleit & Jacobson

[57] ABSTRACT

Properties of a green sand for casting composed of siliceous sand, a combination of Na-type and Ca-type bentonite and water can be improved by utilizing surface activating characteristics of a waste liquor from the pulp manufacturing process. When a pulp cooking waste liquor having a pH of 9 to 13 or a concentrate or powder thereof is incorporated into this green sand, the green strength, the flowability and the packing property are remarkably improved. The used green sand mold has a good disintegrating property and the handling of the return sand is performed very easily, and the temperature control of the return sand can be remarkably facilitated. Further, when this green sand composition is used, occurrence of such defects as buckles, scabs, sand marks and cuts is effectively prevented. When an aluminum ion or transition metal ion is incorporated together with the pulp cooking waste liquor, the foregoing effects are further enhanced.

18 Claims, 2 Drawing Figures

GREEN SAND COMPOSITION FOR CASTING

Cross Reference to Related Application

This application is a continuation-in-part of U.S. Pat. application Ser. No. 785,312, filed Apr. 8, 1977, now U.S. Pat. No. 4,137,085 which was allowed Jul. 17, 1978; issued Jan. 1, 1979.

BACKGROUND OF THE INVENTION

1. Field of the Invention

This invention relates to a green sand composition for use in casting metals. Particularly, this invention relates to a green sand composition utilizing surface activating characteristics of a pulp waste liquor. More particularly, this invention relates to a green sand composition capable of forming a green sand mold of a high-density, which utilizes the surface characteristics which are obtained by controlling the ratio of saccharide derivatives of hydrolyzed hemi-cellulose and lignins contained in a pulp waste liquor from a digester.

2. Description of the Prior Art

High pressure molding methods have recently been developed as methods which meet the need for increasing the speed of manufacture of castings and improving the dimension precision in castings, and green sand composition suitable for such mass-production methods are now required. Green sand is a casting mold sand comprising as main ingredients siliceous sand, bentonite and water. In this green sand composition, the water content is about 3 to about 4% by weight based on the sand. In general, the molding pressure is about 7 to about 40 kg/cm$^2$ and the mold is required to have a hardness of at least 90. In the high pressure molding method, since the water content of the green sand composition is lower than that of conventional green sand composition used for the customary molding method, the surfaces of sand particles are crumbly and the sand particles show insufficient stability and adhesion. Accordingly, defects such as buckles, scabs, sand marks and cuts are readily formed on castings and yields of castings are reduced.

Further, since in the high pressure molding method the recycle speed of molding sand is enhanced and the frequency of contact with molten metals is increased, in case of conventional Ca-type bentonite, ignition aging (inactivation due to heat) is accelerated and defective castings are readily formed by sand sintering or sand fusion. Accordingly, Na-type bentonite having a higher fire resistance than that of Ca-type bentonite is now being used instead of Ca-type bentonite. However, since the hydration speed of Na-type bentonite is lower than that of Ca-type bentonite, it is dispersed in the molding sand in the heterogeneous suspended state and it takes a very long time to obtain a uniform green strength (adhesion strength) of the green sand mold by sufficient permeation of water and sufficient wetting with water. Accordingly, use of Na-type bentonite is not suitable for working the high pressure molding method conducted at high speed. Further, Na-type bentonite is inferior to Ca-type bentonite with respect to the disintegrating property of the molding sand after pouring, and in case of Na-type bentonite, solid agglomerates of fine sand and bentonite are readily formed and the subsequent sand treatment becomes difficult. In order to alleviate these defects of Na-type bentonite, for example, about 25 to about 50% by weight of Ca-type bentonite is incorporated into Na-type bentonite, through the fire resistance inherent of Na-type bentonite is sacrificed to some extent. However, no satisfactory synergistic effect can be obtained in this mixture. As generally known in the art, Na-type bentonite indicates bentonite in which the Na-ion exchange capacity (C.E.C.) is greater than the Ca-ion exchange capacity or in which the amount of $Na_2O$ determined by chemical analysis is greater than that of CaO. On the other hand, Ca-type bentonite indicates bentonite having greater Ca-ion exchange capacity or greater CaO.

In order to obtain a high and uniform mold hardness, it is necessary to improve the flowability and packing property of the green molding sand. For this purpose, there was once adopted a method in which bubbles are formed in the sand by using a surface active agent to render the green sand composition flowable with use of a reduced amount of water and the resulting flowable composition is packed. In this method, however, the bonding power of bentonite is weakened in the recycle system and the mold strength is reduced, resulting in production of defective articles. Therefore, at the present, this method is not practically worked in the art.

The mold to be used in the high pressure molding method and at the high speed is required to have a high hardness. However, in a mold having a high hardness, the part falling in contact with a molten metal is readily destroyed by stress caused by thermal expansion during the casting operation. In order to prevent this defect, an auxiliary binder such as starch, alkali polyuronate, sodium carboxymethyl cellulose, sodium polyglycolate or the like has heretofore been incorporated in the green sand in the powdery state. In this case, however, the degree of wetting with water is greatly changed depending on the mulling (tempering) time, and therefore, it is difficult to attain a uniform scab-preventing effect. By the term "auxiliary binder" is meant a binder to be added to improve the properties of the green sand, which has an activity of assisting the main binder (bentonite).

U.S. Pat. No. 3,086,874 discloses that additive material selected from the group consisting of modified starches and starch derivatives is used in order to prevent rupture or separation of the surface layer or crust of a mold when it is heated by a molten metal being poured into the mold. U.S. Pat. No. 3,086,875 discloses a mixture of a material selected from the group consisting of a starches, modified starches and starch derivatives and a cellulosic material which has been specially treated.

Still further, as additives for assisting the fire resistance of siliceous sand, preventing sand sintering and improving surface conditions of castings, there have heretofore been used carbonaceous additives, for example, coal powders (such as bituminous coal, brown coal, (lignite), peat and sea coal powders), bituminous powders (such as tar pitch powder and asphaltene powder), graphite powder, electrode carbon dust, rosion and synthetic resin powders (inclusive of waste synthetic resin powders such as burrs and liners), having a size of 150±50 mesh (Tyler). Most of these additives do not adhere chemically or physically to the sand surface but they are randomly dispersed among sand particles. Accordingly, these additives are accumulated in excessive amounts in the green sand composition to cause undesirable increase of the carbon content. Further, when such powdery additive is incorporated into the green sand composition, it is mixed with bentonite and hydrated and hence, "spring back" is manifested in the composition to reduce the flowability and air permeability of the green sand. U.S. Pat. No. 3,023,113 discloses a carbonaceous material composed of a mixture of lignite and an aqueous emulsion of asphaltic pitch, and a carbonaceous substance selected from the group consisting of wood flour, coke breeze and mixture thereof and the like.

SUMMARY OF THE INVENTION

The present invention overcomes the above-mentioned various defects and troubles caused on contact interfaces of particles of the green sand. Namely, these defects and troubles can be overcome effectively by a specific green sand composition of the present invention which was completed on the basis of the specific concept of the colloid chemistry. As pointed out hereinbefore, surface active agents have been used in the conventional techniques so as to solve technical problems concerning contact interfaces of sand particles. Since the monomolecular layer of a surface active agent is composed of a non-polymeric linear low-molecular-weight substance (having a molecular weight of 200 to 400), it is adsorbed on the surface of bentonite by molecular orientation. The attractive force among bentonite particles is weakened by the hydrophobic groups adsorbed on the bentonite surface, and as a result, the bonding and hydrating properties inherent of bentonite are inhibited and the green sand mold strength is reduced. I have conducted research work with a view to substituting the adsorbed layer with a polymeric macromolecular film having a good hydrating property, and as a result, I have, by the present invention, now realized a cheap and effective composition fully meeting this object.

In accordance with the present invention, there is provided a green sand composition comprising a green sand composed of siliceous sand, a combination of Na-type and Ca-type bentonite and water, and having incorporated therein a component selected from the group consisting of (a) a waste liquor of a pH 9 to 13 obtained in the soda process, kraft process, or oxygen-alkali cooking process for preparing pulps from woods or non-wooden raw materials, or a concentrate or powder formed from said waste liquor, (b) a waste liquor of a pH of 9 to 13 obtained by cooking a wood or non-wooden material with a liquid mixture of sodium sulfite with sodium hydroxide or sodium carbonate, or a concentrate or powder prepared from said waste liquor, (c) a mixture of a solution of an alkali lignosulfonate having a pH of 9 to 13 with a monosaccharide or polysaccharide or a monosaccharide- or polysaccharide-containing residue left after removing thiolignin from a kraft pulp waste liquor, the mixing ratio being in the range of from 30/70 to 70/30 based on the solids, and (d) a mixture of at least two components selected from said components (a), (b) and (c), the amount incorporated of said components (a), (b), (c) and (d) as the solids thereof being at least 0.01% by weight based on the siliceous sand.

DETAILED DESCRIPTION OF THE INVENTION

Figure 1:
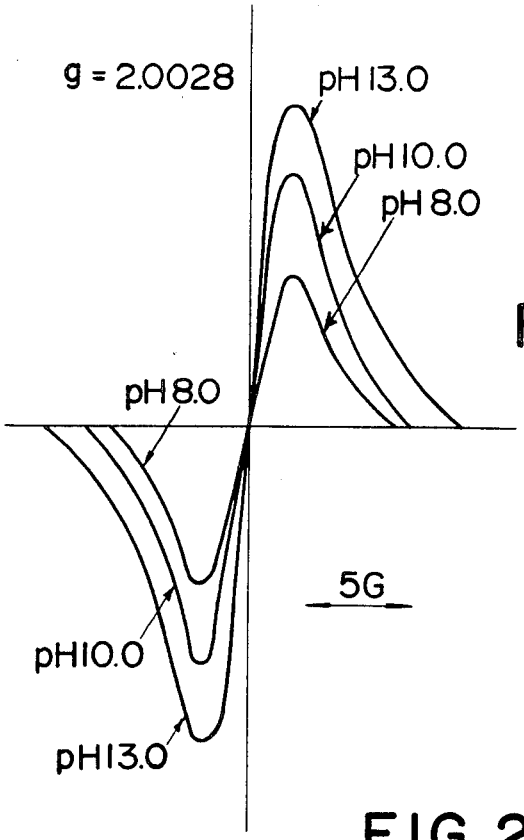

Recently in the pump manufacturing industry, the oxygen-alkali cooking process is practically worked instead of the SP process so as to render the cooking waste liquor non-polluting and recover cooking chemicals. Large amounts of hemicellulose hydrolyzates and the like are contained in waste liquors discharged from this oxygen-alkali cooking process. The present invention skillfully utilizes lignins, hemicellulose hydrolyzates and the like contained in the pulp waste liquor for green sands.

The characteristic effective component of the composition of the present invention is a waste liquor of a pH of 9 to 13 obtained by separating cellulose from a wood for example, a needle-leaved tree or a broad-leaved tree or a non-wooden material such as a bast fiber of a leaf or stalk of flax, corn, straw or bagasse or a seed fiber of cotton or kapok according to the soda process, kraft process, oxygen-alkali cooking process or alkali sulfite process. In the present invention, not only such waste liquor but also a concentrate or powder prepared from such waste liquor by concentration or drying can be used. This waste liquor contained lignines, hemicellulose hydrolyzates, inorganic salts and hydrocarbons differing in molecular weight over a very broad range. The viscosity of this waste liquor or its concentrate is lower than a solution of an ordinary chain macromolecular substance, though it contains macromolecular substances. The reason is considered to be that macromolecular substances such as lignins are dispersed in the waste liquor in the spherical molecular state. Accordingly, in the present invention, macromolecular substances are adsorbed on the sand surfaces without increasing the viscousness among sand particles and the sand surfaces are effectively coated with these macromolecular substances. Further, these macromolecular substances fully exert binder activity without degrading the flowability of the green sand in the wet state and the green strength can be effectively improved. Further, a saccharide derivative of hemicellulose hydrolyzed to a low molecular weight acts as a wetting agent or water retaining agent for the green sand to stabilize the sand surface. A mixture of this substance and a low-molecular-weight lignin (the mixture has a molecular weight of 500 to 1500) has excellent surface tension reducing activity (about 42 dynes/cm -average value obtained by conducting the measurement three times with respect to a 1.0% aqueous solution by using Du Noüy tensiometer) from the viewpoint of polymer chemistry, and it has a high hydrating activity to bentonite. A free phenolic hydroxyl group or an alcoholic saccharate has a property of readily forming chelate complexes with various metal ions, which can be obtained by hydrolysis of salts, preferably sulfate, hydrochloride, borate, phosphate or acetate, more preferably borate or phosphate.

According to the present invention, saccharide derivatives of hemicellulose hydrolyzates contained in an alkali cooking waste liquor or other cooking waste liquor, which have no valuable uses but have heretofore been used as fuels for recovery of cooking chemicals, can be utilized effectively together with lignins for production of green sand compositions. In the present invention, in order to overcome the foregoing defects of the conventional green sand, into a green sand composed of siliceous sand, a combination of the Na-type and Ca-type bentonite and water, there is incorporated (a) a waste liquor of a pH of 9 to 13 obtained in the soda process, kraft process, or oxygen-alkali cooking process for preparing pulps from woods or non-wooden raw materials, or a concentrate or powder formed from said waste liquor, (b) a waste liquor or a pH of 9 to 13 obtained by cooking a wood or non-wooden raw material with a liquid mixture of sodium sulfite with sodium hydroxide or sodium carbonate, or a concentrate or powder prepared from said waste liquor, (c) a mixture of a solution of an alkali lignosulfonate having a pH of 9 to 13 with a monosaccharide or polysaccharide or a monosaccharide- or polysaccharide-containing residue left after removing thiolignin from a kraft pulp waste liquor, the mixing ratio being in the range of from 30/70 to 70/30, preferably 40/60 to 60/40, based on the solids, or (d) a mixture of at least two components selected from said components (a), (b) and (c), the amount incorporated of said component (a), (b), (c) or (d) as the slids thereof being at least 0.01% by weight based on the siliceous sand. The Na-type bentonite and Ca-type bentonite are as defined above.

According to another aspect of the present invention, at least one metal ion may be added to the above component (a), (b), (c) or (d) to convert at least a part thereof to a metal chelate, and the resulting mixture may be incorporated in the above green sand in an amount of at least 0.005% by weight based on siliceous sand. In this case, a metal chelate-containing product formed by adding a metal ion to the component (a), (b), (c) or (d) and agitating the mixture may be admixed with the green sand, or the component (a), (b), (c) or (d) and the metal ion may be incorporated into the green sand independently and the mixture may be tempered to form a green sand composition.

According to still another aspect of the present invention, at least one member selected from the group consisting of starches, sodium alginate, sodium carboxymethyl cellulose, sodium polyglycolate and at least desulphonated lignosulfonic acid alkali metal salts (having a pH of 9 to 13) and/or carbonaceous substances may be further incorporated into the above green sand composition.

In the foregoing green sand composition of the present invention, bubbles are readily formed during the mulling operation, and by utilizing such surface characteristics as wetting, permeation and adsorption and the surface reactivity, the green strength, flowability, packing property and surface stability can be remarkably improved and operations of the entire recycle system starting from the mold formation and ending in the knock-out of the mold can be remarkably facilitated in the high pressure cast molding process.

A pulp cooking waste liquor having a pH of 9 to 13, such as mentioned above, imparts a good green strength and a high bonding property in the wet state to the green sand, but this bonding property is reduced in the dry state at a temperature higher than 100° C. Accordingly, the disintegrating property of the molding sand after pouring can be improved by such pulp cooking waste liquor.

In the component (c), if the ratio of the saccharide is not more than 30%, the intended surface stability, water-retaining property or green strength cannot be obtained in the recycle system. In the case that the ratio is more than about 70%, it is difficult to entrain air during the mulling operation and thus the desired results cannot be obtained. Further, in the range of 40 through 60%, especially good results can be obtained in the recycle system.

The effective component (a), (b), (c) or (d) of the present invention is incorporated in an amount of at least 0.01% by weight when the metal chelate complex is not formed, and the intended effects can be attained if the effective component is incorporated in such amount. It is preferred that the effective component be incorporated in an amount of 0.01 to 6% by weight, especially preferably 0.02 to 4% by weight. When the metal chelate complex is formed, the intended effects can be attained by incorporating the effective component in an amount of at least 0.005% by weight, preferably 0.005 to 6% by weight, especially preferably 0.01 to 4% by weight. In each case, the upper limit of the amount incorporated of the effective component is determined from the economical viewpoint.

The waste liquor that is used in the present invention is a mixture and has a surface tension lower than that of water (72 dynes/cm), which varies in a relatively broad range (54±12 dynes/cm) owing to the difference among molecular weight divisions of the waste liquor. When a metal chelate complex is formed from a part of the waste liquor and a metal ion, this chelate complex acts as a polycondensation catalyst and acts to enhance the catalytic activity of the bentonite used and to retain a sufficient strength in membranes of bubbles formed among sand particles. Still further, since the surface tension of the waste liquor is low, wetting and permeating of water into bentonite layers is accelerated over the case where water alone is used. Still in addition, since the waste liquor has a high hydrating property, it promotes peptization and swelling of bentonite. Therefore, at the mulling step, the time required for obtaining the desired tempered state in the green sand composition can be remarkably shortened. Still further, since it is possible to sufficiently wet the surface of siliceous sand and bentonite layers with use of a reduced amount of water, a sufficient mold strength can easily be obtained. The saccharide derivative of the hemicellulose hydrolyzate contained in the waste liquor, which acts as swelling agent, has a good compatibility with starch, sodium algninate, sodium carboxymethyl cellulose, sodium polyglycolate and molasses. It has a high alkalinity. Accordingly, starch and the like is solubilized while the green sand composition is agitated and mulled at room temperature. As a result, the water-retaining property of the green sand which is recycled is highly improved and the surface stability of the sand particles is enhanced. Moreover, this saccharide derivative has an activity of preventing aging of starch or the like in the wet state. By the term "aging of starch" is meant the phenomenon of $\alpha$-starch being gradually converted in the wet state to $\beta$-starch and the viscousness being lost. In general, solubilization of starch at room temperature is accomplished by agitating starch in an aqueous medium by using about 10 to about 18% by weight, based on starch, of an alkali metal hydroxide and a small amount of aquous hydrogen peroxide. I noted that a waste liquor discharged from the step of alkali cooking or a wood or non-wooden material has an alkali concentration similar to the above alkali concentration and a stable free radial of lignin is formed by the contact of the waste liquor with air, and in continuing my research work I found that when the above waste liquor is contacted and agitated with starch or the like at room temperature in the presence of the green sand, not only solubilization of starch or the like but also coupling, grafting and blocking reactions by the metal chelate are caused to occur, and low-molecule-weight substances contained in the waste liquor are converted to macromolecular substances, whereby the green strength of the green sand is remarkably improved and generation of defects such as scabs is effectively prevented.

The effective component is efficiently adsorbed on the surface of a carbonaceous substance. Accordingly, a carbonaceous additive effective for improving the casting surface, enhancing the fire resistance of siliceous sand and preventing the sand sintering can be coated with a macromolecular film of the effective component in a uniformly dispersed state on the surfaces of particles of the green sand. Therefore, the amount used of the carbonaceous additive can be remarkably reduced. The carbonaceous additive layer coated with a macromolecular adsorption film of the effective component of the present invention is carbonized at the pouring step, whereby the disintegrating property of bentonite after pouring can be effectively improved and the amount of the green sand adhering to the surface of a cast article can be reduced. Accordingly, the disintegrated sand to be returned can be treated very easily.

As will be apparent from the foregoing illustration, defects of Na-type bentonite, such as low hydrating property and inferior disintegrating property can be remarkably moderated in the composition of the present invention. Therefore, according to the present invention, it is possible to use Na-type bentonite singly, that is, without Ca-type bentonite and, of course, it is also possible to use a combination of both the Na-type and Ca-type bentonite, in the high pressure molding process conducted at high speed. In the latter, the ratio of Ca-type bentonite can be adopted by those skilled in the art as the case may be. For example, the ratio of Ca-type bentonite is not more than 50% by weight based on the total bentonite, preferably not more than about 40% by weight, especially preferably not more than about 30% by weight.

In this invention, there can be used bentonites which are known in the art. For example, the bentonites include bentonite from America, e.g. Wyoming Fort-Benton, Wyoming Upton, California Otay, Mississippi Polkville, Mississippi Pontotac or Arizona Chambers, and the like.

When the effective component of the composition of the present invention, which has an excellent surface activating capacity, is added to the green sand and the mixture is agitated, a great number of fine bubbles are intruded into the sand from the surfaces falling in contact with air, and therefore, the effect of aerating the mixture is remarkably improved. In the present invention, bubble generation and defoaming advance simultaneously and the green sand is densely squeezed by virtue of fine voids left after disappearance of bubbles. Therefore, the sand mold is hardly influenced by the back pressure (spring back) and a higher and more uniform mold strength can be obtained under a given pressure and application of an excessively high pressure becomes unnecessary. The composition of the present invention can be formed into a green sand mold of high-density under a pressure, which is ordinarily used in the high speed molding method in the art. The saccharide derivative of the hemicellulose hydrolyzate is not evaporated or carbonized at or after the pouring step but is left in the sand in the water-retaining state. Accordingly, the heat accumulated in the sand particles is effectively exchanged by the water-retaining derivative and the contacting air and discharge of heat is accomplished conveniently, and there is attained an advantage that the temperature of the recovered sand (return sand) can be controlled very easily.

Figure 2:
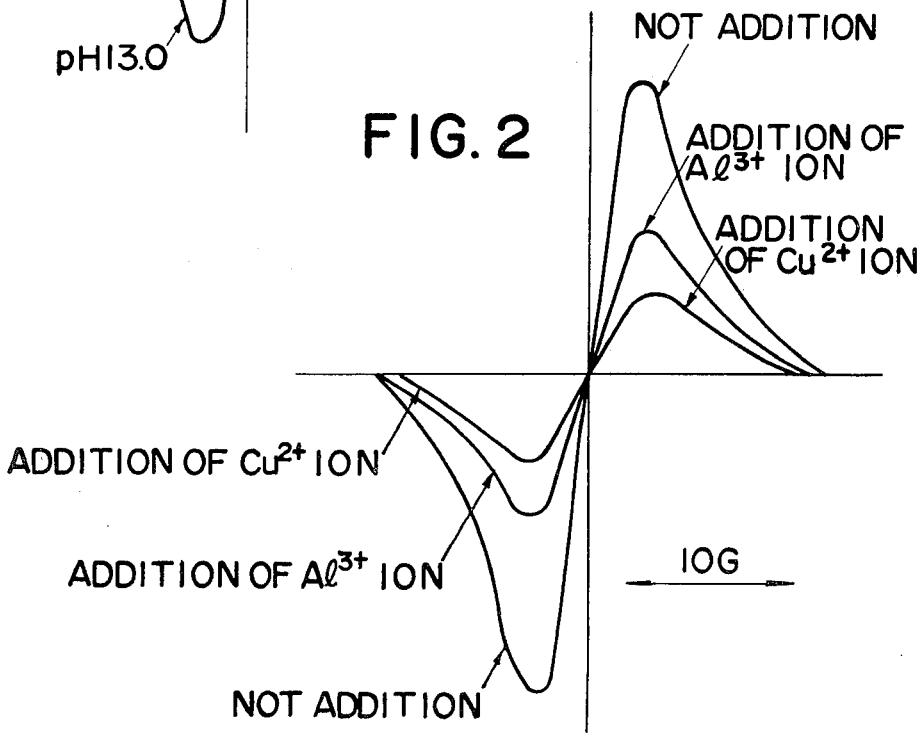

The lignin free radical will now be described with reference to the accompanying drawings, in which:

FIG. 1 shows an electron spin resonance absorption spectrum (scale: 1/6) which illustrates the influence of the pH of the lignin free radical in a 5% aqueous solution of sodium lignosulfonate; and FIG. 2 shows an electron spin resonance absorption spectrum which illustrates the influence of a metal ion ($Al^{3+}$or $Cu^{2+}$) on the lignin free radical in a 1.6% aqueous solution of thiolignin of a pH of 10 to which $3\times10^{-4}$ mole/liter of the metal ion is added.

In aqueous solutions of an alkali lignosulfonate or thiolignin, the quantity of the free radical of lignin is increased as the pH is increased. This free radical is stable in the alkaline region and formation of the free radical is maximum at a pH of 13. By contact with air by agitation, formation of the free radical is enhanced and maintained at a high level. The foregoing will be apparent from the electron spin resonance spectrum (ESR spectrum) of FIG. 1 which shows that the quantity of the free radical is increased as the pH is elevated in a 5% aqueous solution of sodium lignosulfonate. It is construed that the hydrogen-drawing action of oxygen dissolved in the alkaline aqueous solution makes contributions to formation of the free radical of lignin. As regards the stability of such free radical, Steelink et al. presume that radicals stable under an alakline condition may probably be given by a compound having an orthoquinone or cathecol type structure and report data about semiquinone anion radicals formed from such compound (J. Am. Chem. Soc., 85, 4048, 1963).

The substance that can be added as a catalyst for conducting a polycondensation reaction by utilizing the lignin free radical includes an aluminum ion, a transition metal ion or the like. It has been found that when such metal ion is incorporated in an aqueous solution of thiolignin, the quantity of the free radical is decreased, as shown in the ESR spectrum of FIG. 2. Thus, it has been confirmed that this free radical has such activity as will initiate the graft polymerization. As typical instances of the transition metal ions, there can be mentioned ions of Cu, Zn, Ti, Cr, Mn, Fe, Co, Ni and Mg. Preferred metal ions are $Al^{3+}$, $Cu^{2+}$, $Mn^{2+}$, $Fe^{2+}$and $Fe^{3+}$. Reduction of the quantity of the free radical is clearly observed when such metal ions are incorporated. The effect of reducing the quantity of the free radical is attained when the metal ion is incorporated in an amount of at least $5\times10^{-4}$ mole per 100 g of the lignin, preferably $5\times10^{-4}$ to $5\times10^{-1}$ mole per 100 g of the lignin, especially preferably $3\times10^{-2}$ to $1\times10^{-3}$ mole per 100 g of the lignin. If the quantity of the metal ion is smaller than $5\times10^{-4}$ mole per 100 g of the lignin, no substantial reduction of the quantity of the free radical is observed. Even if the quantity of the metal ion is increased beyond $5\times10^{-1}$ mole per 100 g of the lignin, no substantial enhancement of the free radical-reducing effect is attained. Accordingly, the upper limit of the quantity of the metal ion must be determined from the economical viewpoint. It was found that when $Fe^{2+}$or $Fe^{3+}$is incorporated in an amount of $1\times10^{-3}$ mole per 100 g of the lignin, the quantity of the free lignin radical is promptly reduced.

As will be apparent from the foregoing illustration, the free lignin radical has an activity sufficient to initiate the coupling reaction, the graft polymerization and the block polymerization. Accordingly, when a pulp cooking waste liquor having a pH of 9 to 13 and containing ligniferous substances is agitated and contacted with starch, desulfonated lignosulfonic acid alkali metal salt having a pH of 9 to 13, sodium alginate, sodium carboxymethyl cellulose or sodium polyglycolate, a hydrophilic macro-molecular graft polymer having a stretched molecule form is obtained at room temperature. It is believed that by virtue of this graft polymer, a uniform and green sand mold strength can be obtained in the present invention. More specifically, the free radical of lignin which is increased in the waste liquor by contact with air by agitation (by means of a Simpson mixer or a speed mill type agitator) is subjected to oxidation-reduction reaction with a metal chelate complex formed from a metal salt added and a part of saccharic acid or a free phenolic hydroxyl group in the waste liquor. An adsorption film of the resulting hydrophilic product formed from the lignin hemicellulose hydrolyzate and starch, an alkali alignate, a desulfonated lignisulfonic acid alkali metal salt having a pH of 9 to 13, sodium carboxymethyl cellulose or sodium polyglycolate has a high molecular weight and hence, it can improve the green strength of the green sand.

This alkaline carbonaceous adsorption film does not degrade swelling and peptization of bentonite in the recycle system of the high pressure molding method conducted at high speed. The uniformly oriented carbonaceous substance formed by carbonization of this adsorption film protects bentonite from ignition aging. Accordingly, deactivation of bentonite can be effectively prevented and formation of dust can be remarkably reduced. Thus, it is construed that a high bonding ability is maintained in the molding sand and the working environment is remarkably improved.

Pulp waste liquors obtained according to variouss known methods can be used in the present invention. For example, pulp waste liquors obtained according to the following methods can be advantageously used in the present invention.

(A) Non-Wooden Material

As the non-wooden raw material, there can be used cotton linter from which different substances incorporated have been removed, and manila hemp, rice straw, wheat straw, bagasse and corn stalk which have been cut into 3 to 4 cm. According to the soda process, the raw material is cooked at 155° C. and 5 kg/cm$^2$ for 3.5 hours at a liquid ratio of 3.5 by using a 13% aqueous solution of sodium hydroxide. In case of the oxygen-alkali method, air in a digester is replaced by oxygen and the oxygen pressure is adjusted to 5 kg/cm$^2$ at 20° C., and cooking is conducted at an oxidation temperature of 120° C. for 1.5 hours at a liquid ratio of 3.5 by using a 15% aqueous solution of sodium hydroxide. The waste liquor is recovered and if desired, it is concentrated to a solid content of 50% or evaporated by dryness to obtain a powder. Each of the thus recovered waste liquor, concentrate and powder can be used in the present invention.

(B) Wood

Chips of broad-leaved and needle-leaved trees produced in Japan can be used as the raw material. The raw material is subjected to kraft cooking at an active alkali content of 17%, a sulfurization degree of 25% and a maximum temperature of 160° C. for a retention time of 2 hours. The waste liquor is collected and, if desired, it is concentrated to a solid content of 50% or evaporated to dryness to obtain a powder. Each of the so recovered waste liquor, concentrate and powder can be used in the present invention.

(C) Non-Wooden Material and Wood

A wood or non-wooden material such as mentioned above is cooked at 170° C. and 7 kg/cm$^2$ and 3 hours at a liquid ratio of 3.5 by using a 15% aqueous solution of sodium sulfite or a 5% aqueous solution of sodium hydroxide or sodium carbonate. The waste liquor may be used after concentration or evaporation to dryness.

The present invention will now be described in detail with reference to the following examples that by no means limit the scope of the invention. Fluttery siliceous sand produced in Australia, which was used in the following examples, was found to have a size distribution of 8.6% of 35 mesh, 19.0% of 48 mesh, 31% of 65 mesh, 37.2% of 100 mesh and 3.4% of 150 mesh.

EXAMPLE 1

| | |
|---|---|
| Fluttery siliceous sand (fresh sand) | 100 parts by weight |
| Bentonite produced in Wyoming, U.S.A. | 8 parts by weight |
| Water | 4 parts by weight |

EXAMPLE 2

| | |
|---|---|
| Fluttery siliceous sand (fresh sand) | 100 parts by weight |
| Bentonite produced in Wyoming, U.S.A. | 8 parts by weight |
| Waste liquor concentrated powder (i)* | 2 parts by weight |
| Water | 4 parts by weight |

*(1) Powder obtained by concentrating and evaporating to dryness a waste liquor obtained by cooking a broad-leaved tree by the kraft process according to the procedure (B) described above.

EXAMPLE 3

In the composition of Example 2, the waste liquor concentrated powder (i) was replaced by the same amount of a concentrated powder obtained from a waste liquor of a pH of 13 formed by oxygen-alkali cooking of bagasse according to the procedure (A) described above.

EXAMPLE 4

In the composition of Example 2, the waste liquor concentrated powder (i) was replaced by the same amount of a concentrated powder obtained from a waste liquor of a pH of 11 formed by cooking cotton linter by the soda process according to the procedure described in (A) above.

EXAMPLE 5

In the composition of Example 2, the waste liquor concentrated powder (i) was replaced by a mixture comprising 50% of a powder of desulfonated sodium lignosulfonate (sulfur content lower than 3%) obtained from a waste liquor of a pH 13 formed by cooking of a needle-leaved tree according to the procedure (C) described above and 50% of a monosaccharide and polysaccharide derivative powder obtained from a residual liquid left after removal of thiolignin.

EXAMPLE 6

In the composition of Example 2, the waste liquor concentrated powder (i) was replaced by the same amount of a powder obtained by concentrating and evaporating to dryness a waste liquor of a pH of 9 formed by cooking wheat straw by the sodium sulfite process according to the procedure (C) described above.

EXAMPLE 7

In the composition of Example 2, the amount of the waste liquor concentrated powder (i) was changed to 5 parts by weight.

EXAMPLE 8

| | |
|---|---|
| Fluttery siliceous sand (fresh sand) | 100 parts by weight |
| Bentonite produced in Wyoming, U.S.A | 8 parts by weight |
| Coal powder | 1 part by weight |
| Green starch ($\beta$-type) | 0.5 part by weight |
| Chelated waste liquor concentrated powder (ii)* | 1 part by weight |
| Water | 3.5 parts by weight |

*(ii) A 50% concentrated waste liquor of a pH of 13 obtained by oxygen alkali cooking of rice straw or wheat straw according to the procedure (A) described above was mixed with $Cu^{2+}$ in an amount of $3 \times 10^{-2}$ mole per 100 g of the lignin. The chelated concentrate was evaporated to dryness to obtain a powder, which was used in the above composition.

EXAMPLE 9

In the composition of Example 8, the amount of the waste liquor concentrated powder (ii) was changed to 5 parts by weight.

EXAMPLE 10

| | |
|---|---|
| Fluttery siliceous sand (return sand) | 100 parts by weight |
| Fluttery siliceous sand (fresh sand) | 2 parts by weight |
| Bentonite produced in Wyoming, U.S.A. | 0.3 part by weight |
| Chelated waste liquor concentrated powder (iii)* | 0.02 part by weight |
| Water | 3 parts by weight |

*(iii) A 50% concentrated waste liquor of a pH of 11 obtained by cooking manila hemp by the soda process according to the procedure (A) described above was mixed with $Fe^{3+}$ in an amount of $1 \times 10^{-3}$ mole per 100 g of the lignin. The chelated concentrate was evaporated to dryness to obtain a powder, which was used in the above composition.

EXAMPLE 11

| | |
|---|---|
| Fluttery siliceous sand (return sand) | 100 parts by weight |
| Fluttery siliceous sand (fresh sand) | 2 parts by weight |
| Bentonite produced in Wyoming, U.S.A. | 0.3 part by weight |
| Cured waste alkyd resin powder | 0.1 part by weight |
| Powdery sodium alginate or sodium carboxymethyl cellulose | 0.02 part by weight |
| Chelated waste liquor concentrated powder (iv)* | 0.02 part by weight |
| Water | 3 parts by weight |

*(iv) A 50% concentrate (pH 13) of sodium ligno-sulfonate was mixed at a mixing ratio of 1:1 with a 50% concentrated waste liquor of a pH of 13 obtained by cooking corn stalk by the soda process according to the procedure (A) described above, and $Al^{3+}$ was incorporated into the mixture in an amount of $3 \times 10^{-2}$ mole per 100 g of the lignin. The resulting chelated liquor was evaporated to dryness to obtain a powder, which was used in the above composition.

EXAMPLE 12

| | |
|---|---|
| Fluttery siliceous sand (return sand) | 100 parts by weight |
| Fluttery siliceous sand (fresh sand) | 2 parts by weight |

-continued

| | |
|---|---|
| Bentonite produced in Wyoming, U.S.A. | 0.3 part by weight |
| Cured waste phenolic resin | 0.1 part by weight |
| Waste PVA powder | 0.02 part by weight |
| Chelated waste liquor concentrated powder (iv) | 0.02 part by weight |
| Water | 3 parts by weight |

EXAMPLE 13

In the composition of Example 10, 11 or 12, the amount of the waste liquor concentrated powder (iii) or (iv) was changed to 4 parts by weight.

EXAMPLE 14

In the composition of Examples 2, 3, 4 or 5, the waste liquor concentrated powder was replaced by 1 part by weight of the chelated waste liquor powder (ii), (iii) and/or (iv).

Wyoming Upton, which was used in the following examples, contains 55.44% of $SiO_2$, 20.14% of $Al_2O_3$, 3.67% of $Fe_2O_3$, 0.30% of FeO, 0.50% of CaO, 2.49% of MgO, 2.75% of $Na_2O$, 0.60% of $K_2O$, 0.10% of $TiO_2$ and 14.70% of $H_2O-$ and $H_2O+$, and Mississippi Pontonac contains 57.55% of $SiO_2$, 19.93% of $Al_2O_3$, 6.35% of $Fe_2O_3$, 0.95% of FeO, 1.94% of CaO, 3.92% of MgO, 0.33% of $Na_2O$, 0.59% of $K_2O$, 0.32% of $TiO_2$ and 8.53% of $H_2O+$ ("Clay Handbook" edited by Japanese Clay Society and published by K. K. Gihodo, page 731, Table 10.35, Oct. 1. 1967).

EXAMPLE 15

| | |
|---|---|
| Fluttery siliceous sand (fresh sand) | 100 parts by weight |
| 70% by weight of Wyoming Upton and 30% by weight of Mississippi Pontonac | 8 parts by weight |
| Water | 4 parts by weight |

EXAMPLE 16

| | |
|---|---|
| Fluttery siliceous sand (fresh sand) | 100 parts by weight |
| 70% by weight of Wyoming Upton and 30% by weight of Mississippi Pontonac | 8 parts by weight |
| Waste liquor concentrated powder (i) | 2 parts by weight |
| Water | 4 parts by weight |

EXAMPLE 17

In the composition of Example 16, the waste liquor concentrated powder (i) was replaced by the same amount of a concentrated powder obtained from a waste liquor of a pH of 13 formed by oxygen-alkali cooking of bagasse according to the procedure (A) described above.

EXAMPLE 18

In the composition of Example 16, the waste liquor concentrated powder (i) was replaced by the same amount of a concentrated powder obtained from a waste liquor of a pH of 11 formed by cooking cotton linter by the soda process according to the procedure described in (A) above.

EXAMPLE 19

In the composition of Example 16, the waste liquor concentrated powder (i) was replaced by a mixture comprising 50% of a powder of desulfonated sodium lignosulfonate (sulfur content lower than 3%) obtained from a waste liquor of a pH 13 formed by cooking of a needle-leaved tree according to the procedure (C) described above and 50% of a monosaccharide and polysaccharide derivative powder obtained from a residual liquid left after removal of thiolignin.

EXAMPLE 20

In the composition of Example 16, the waste liquor concentrated powder (i) was replaced by the same amount of a powder obtained by concentrating and evaporating to dryness a waste liquor of a pH of 9 formed by cooking wheat straw by the sodium sulfite process according to the procedure (C) described above.

EXAMPLE 21

In the composition of Example 16, the amount of the waste liquor concentrated powder (i) was changed to 5 parts by weight.

EXAMPLE 22

| | |
|---|---|
| Fluttery siliceous sand (fresh sand) | 100 parts by weight |
| 70% by weght of Wyoming Upton and 30% by weight of Mississippi Pontonac | 8 parts by weight |
| Coal powder | 1 part by weight |
| Green starch (β-type) | 0.5 part by weight |
| Chelated waste liquor concentrated powder (ii) | 1 part by weight |
| Water | 3.5 parts by weight |

EXAMPLE 23

In the composition of Example 22, the amount of the waste liquor concentrated powder (ii) was changed to 5 parts by weight.

EXAMPLE 24

| | |
|---|---|
| Fluttery siliceous sand (return sand) | 100 parts by weight |
| Fluttery siliceous sand (fresh sand) | 2 parts by weight |
| 70% by weight of Wyoming Upton and 30% by weight of Mississippi Pontonac | 0.3 part by weight |
| Chelated waste liquor concentrated powder (iii) | 0.02 part by weight |

-continued

| | |
|---|---|
| Water | 3 parts by weight |

EXAMPLE 25

| | |
|---|---|
| Fluttery siliceous sand (return sand) | 100 parts by weight |
| Fluttery siliceous sand (fresh sand) | 2 parts by weight |
| 70% by weight of Wyoming Upton and 30% by weight of Mississippi Pontonac | 0.3 part by weight |
| Cured waste alkyd resin powder | 0.1 part by weight |
| Powdery sodium alginate or sodium carboxymethyl cellulose | 0.02 part by weight |
| Chelated waste liquor concentrated powder (iv) | 0.02 part by weight |
| Water | 3 parts by weight |

EXAMPLE 26

| | |
|---|---|
| Fluttery siliceous sand (return sand) | 100 parts by weight |
| Fluttery siliceous sand (fresh sand) | 2 parts by weight |
| 70% by weight of Wyoming Upton and 30% by weight of Mississippi Pontonac | 0.3 part by weight |
| Cured waste phenolic resin | 0.1 part by weight |
| Waste PVA powder | 0.02 part by weight |
| Chelated waste liquor concentrated powder (iv) | 0.02 part by weight |
| Water | 3 parts by weight |

EXAMPLE 27

In the composition of Example 24, 25 or 26, the amount of the waste liquor concentrated powder (iii) or (iv) was changed to 4 parts by weight.

EXAMPLE 28

In the composition of Example 16, 17, 18 or 19, the waste liquor concentrated powder was replaced by 1 part by weight of the chelated waste liquir powder (ii), (iii) and/or (iv).

PHYSICAL PROPERTY TEST

Each of the compositions shown in the foregoing Examples was mixed at 45 rpm for 3 minutes by a Simpson mixer to obtain a green sand composition. Physical properties shown in Table 1 were tested with respect to typical compositions to obtain the results shown in Table 1.

Table 1

| Example No. | Water Content (%) | Air Permeability | Green Tensile Strength kg/cm$^2$ | Flowability (%) (Diettert method) | Compactability (%) | Hardness after 3 Times Rammining of Green Sand Mold | |
|---|---|---|---|---|---|---|---|
| | | | | | | Top Face | Bottom Face |
| 1 | 4 | 97 | 0.85 | 81 | 45 | 85 | 83 |
| 2 | 4 | 104 | 1.2 | 88 | 40 | 92 | 91 |
| 3 | 4 | 104 | — | 85 | 42 | — | — |
| 7 | 4 | 95 | 1.5 | 83 | — | — | — |
| 8 | 3.5 | 95 | 1.35 | 79 | 41 | 92 | 91 |
| 9 | 3.5 | — | 1.6 | — | — | — | — |
| 10 | 3 | 103 | 1.5 | 83 | 36 | 93 | 92 |
| 11 | 3 | 99 | 1.6 | 79 | 41 | 94 | 93 |
| 12 | 3 | 99 | 1.6 | 79 | 41 | 94 | 93 |
| 15 | 4 | 97 | 0.85 | 81 | 45 | 85 | 83 |

Table 1-continued

| Example No. | Water Content (%) | Air Permeability | Green Tensile Strength kg/cm² | Flowability (%) (Diettert method) | Compactibility (%) | Hardness after 3 Times Rammining of Green Sand Mold | |
|---|---|---|---|---|---|---|---|
| | | | | | | Top Face | Bottom Face |
| 16 | 4 | 105 | 1.3 | 88 | 39 | 92 | 92 |
| 17 | 4 | 105 | — | 85 | 42 | — | — |
| 21 | 4 | — | 1.5 | 83 | — | — | — |
| 22 | 3.5 | 95 | 1.4 | 76 | 40 | 94 | 92 |
| 23 | 3.5 | — | 1.6 | — | — | — | — |
| 24 | 3 | 103 | 1.5 | 80 | 35 | 95 | 92 |
| 25 | 3 | 102 | 1.6 | 76 | 39 | 96 | 93 |
| 26 | 3 | 102 | 1.7 | 76 | 38 | 96 | 93 |

Moreover, results obtained with respect to the compositions of Examples 4, 5 and 6 were similar to those obtained with respect to the composition of Example 3. Results obtained with respect to Example 13 were similar to those obtained with respect to the composition of Example 9 and results obtained with respect to the composition of Example 14 were similar to those obtained in Example 8. Results obtained with respect to the compositions of Examples 18, 19 and 20 were similar to those obtained with respect to the composition of Example 17. Results obtained with respect to Example 27 were similar to those obtained with respect to the composition of Example 23 and results obtained with respect to the composition of Example 28 were similar to those obtained in Example 22.

From the foregoing physical property test results, it will readily be understood that when the composition of the present invention is used, the green strength of the mold is improved and the flowability, packing property and green mold hardness of the green sand composition are improved. Further, good results can also be obtained even when return sand is employed. Accordingly, a green sand composition including return sand recycled is effectively used in the present invention.

As will be apparent from the foregoing results, the problem that could not be solved by the conventional techniques, namely the problems of reciprocity between the flowing and packing characteristics and the green strength, can be effectively solved by the composition of the present invention. Further, in the present invention, colloidal characteristics and interfacial properties of non-utilized resources, such as pulp cooking waste liquors, are skillfully employed for a molding method conducted at high speed, in which the green sand mold of high-density is used, whereby the temperature control of recovered sands, which requires expensive equipment in the conventional techniques, can be remarkably facilitated and properties of the green sand for the molding method conducted at high speed can be remarkably improved. Accordingly, the present invention makes great contributions to the art.

Other features, advantages and specific embodiments of the invention will become readily apparent to those exercising ordinary skill in the art after reading the foregoing disclosures. In this connection, while specific embodiments of the invention have been described in considerable detail, variations and modifications of these embodiments can be effected without departing from the spirit and scope of the invention as disclosed and claimed.

What I claim is:

1. A green sand composition for casting comprising a green sand composed of siliceous sand, a combination of Na-type and Ca-type bentonite, and water, and having incorporated therein a component selected from the group consisting of (a) a waste liquor of a pH of 9 to 13 obtained in the soda process, kraft process, or oxygen-alkali cooking process for preparing pulps from woods or non-wooden raw materials, or a concentrate or powder formed from said waste liquor, (b) a waste liquor of a pH of 9 to 13 obtained by cooking a wood or non-wooden material with a liquid mixture of sodium sulfite with sodium hydroxide or sodium carbonate, or a concentrate or powder prepared from said waste liquor, (c) a mixture of a solution of an alkali lignosulfonate having a pH of 9 to 13 with a monosaccharide or polysaccharide or a monosaccharide-or polysaccharide-containing residue left after removing thiolignin from a kraft pulp waste liquor, the mixing ratio being in the range of 30/70 to 70/30 based on the solids, and (d) a mixture of at least two components selected from said components (a), (b) and (c), the amount incorporated of said component (a), (b), (c) or (d) as the solids thereof being at least 0.01% by weight based on the siliceous sand.

2. A green sand composition as set forth in claim 1, wherein the mixing ratio in the component (c) is in the range of 40/60 to 60/40 based on the solids.

3. A green sand composition as set forth in claim 1 wherein the amount incorporated of the component (a), (b), (c) or (d) as the solids thereof is 0.02% to 4% by weight based on the siliceous sand.

4. A green sand composition as set forth in claim 1 wherein the bentonite is present in the amount of about from 0.3% to 8% by weight based on the siliceous sand.

5. A green sand composition as set forth in claim 1 wherein the water is present in about from 3% to 4% by weight based on the siliceous sand.

6. A green sand composition as set forth in claim 1 wherein a carbonaceous additive and/or an auxiliary binder are incorporated in the green sand.

7. A green sand composition as set forth in claim 6 wherein the carbonaceous additive is a member selected from the group consisting of a coal powder, a bituminous powder, graphite powder, electrode carbon dust, rosin and a synthetic resin powder.

8. A green sand composition as set forth in claim 6 wherein the auxiliary binder is a member selected from the group consisting of starch, sodium alginate, sodium carboxymethyl cellulose, sodium polyglycolate, and a desulphonated lignosulfonic acid alkali metal salt having a pH of 9 to 13.

9. A green sand composition as set forth in claim 6 which contains both (a) a carbonaceous additive selected from the group consisting of a coal powder, a bituminous powder, graphite powder, electrode carbon dust, rosin and a synthetic resin powder and (b) an auxiliary binder selected from the group consisting of starch, sodium alginate, sodium carboxymethyl cellulose, sodium polyglycolate, and a desulphonated lignosulfonic acid alkali metal salt having a pH of 9 to 13.

10. A green sand composition for casting comprising a green sand composed of siliceous sand, a combination of Na-type and Ca-type bentonite and water, and having incorporated therein a chelate complex-containing mixture obtained by adding at least one metal ion selected from the group consisting of aluminum and transition metal ions to a component selected from the group consisting of (a) a waste liquor of a pH of 9 to 13 obtained in the soda process, kraft process, or oxygen-alkali cooking process for preparing pulps from woods or non-wooden raw materials, or a concentrate or powder formed from said waste liquor, (b) a waste liquor of a pH of 9 to 13 obtained by cooking a wood or non-wooden material with a liquid mixture of sodium sulfite with sodium hydroxide or sodium carbonate, or a concentrate or powder prepared from said waste liquor, (c) a mixture of a solution of an alkali lignosulfonate having a pH of 9 to 13 with a monosaccharide or polysaccharide or a monosaccharide- or polysaccharide-containing residue left after removing thiolignin from a kraft pulp waste liquor, the mixing ratio being in the range of from 30/70 to 70/30 based on the solids, and (d) a mixture of at least two components selected from the components (a), (b) and (c), the amount added of the metal ion being at least $5\times10^{-4}$ mole per 100 g of the lignin contained in the component (a), (b), (c) or (d), the amount incorporated of the chelate complex-containing mixture as the solids thereof being at least 0.005% by weight based on the siliceous sand.

11. A green sand composition as set forth in claim 10, wherein the mixing ratio in the component (c) is in the range of 40/60 to 60/40 based on the solids thereof.

12. A green sand composition as set forth in claim 10 wherein the amount incorporated of the chelate complex-containing mixture as the solids thereof is 0.01 to 4% by weight based on the siliceous sand.

13. A green sand composition as set forth in claim 10 wherein the metal ion is at least one member selected from the group consisting of Al, Cu, Zn, Ti, Cr, Mn, $Fe^{2+}$, $Fe^{3+}$, Co, Ni and Mg ions.

14. A green sand composition as set forth in claim 10 wherein the metal ion is added in an amount of $3\times10^{-2}$ to $1\times10^{-3}$ mole per 100 g of the lignin in the component (a), (b), (c) or (d).

15. A green sand composition as set forth in claim 10 wherein a carbonaceous additive and/or auxiliary binder are additionally incorporated in the green sand.

16. A green sand composition as set forth in claim 15 wherein the carbonaceous additive is a member selected from the group consisting of a coal powder, a bituminous powder, graphite powder, electrode carbon dust, rosin and a synthetic resin powder.

17. A green sand composition as set forth in claim 15 wherein the auxiliary binder is a member selected from the group consisting of starch, sodium alginate, sodium carboxymethyl cellulose, sodium polyglycolate, and a desulphonated lignosulfonic acid alkali metal salt having a pH of 9 to 13.

18. A green sand composition as set forth in claim 15 which contains both (a) a carbonaceous additive selected from the group consisting of a coal powder, a bituminous powder, graphite powder, electrode carbon dust, rosin and a synthetic resin powder and (b) an auxiliary binder selected from the group consisting of starch, sodium alginate, sodium carboxymethyl cellulose, sodium polyglycolate, and a desulphonated lignosulfonic acid alkali metal salt having a pH of 9 to 13.

* * * * *